US007441285B2

(12) United States Patent
Kemp et al.

(10) Patent No.: US 7,441,285 B2
(45) Date of Patent: Oct. 28, 2008

(54) REMOVABLE TUB GRIP

(75) Inventors: Douglas A. Kemp, North Ridgeville, OH (US); Alan Bauer, Medina, OH (US)

(73) Assignee: Moen Incorporated, North Olmsted, OH (US)

( * ) Notice: Subject to any disclaimer, the term of this patent is extended or adjusted under 35 U.S.C. 154(b) by 259 days.

(21) Appl. No.: 10/710,456

(22) Filed: Jul. 13, 2004

(65) Prior Publication Data

US 2006/0010594 A1 Jan. 19, 2006

(51) Int. Cl.
*A47K 3/022* (2006.01)

(52) U.S. Cl. ..... 4/577.1

(58) Field of Classification Search ..... 4/576.1, 4/577.1; 269/6, 68, 194, 212, 214, 215
See application file for complete search history.

(56) References Cited

U.S. PATENT DOCUMENTS

| | | | | |
|---|---|---|---|---|
| 2,034,705 | A | | 3/1936 | Anderson et al. |
| 2,156,186 | A | * | 4/1939 | Maki ..... 269/157 |
| 2,416,621 | A | | 2/1947 | Gretschal |
| 2,642,581 | A | | 6/1953 | Loe |
| 2,750,690 | A | | 6/1956 | Gomersall |
| 2,756,439 | A | | 7/1956 | Bollen |
| 2,807,029 | A | | 9/1957 | Armstrong |
| 2,931,051 | A | | 4/1960 | Sparling |
| D188,175 | S | | 6/1960 | Craig et al. |
| 2,940,085 | A | | 6/1960 | Hussey |
| D189,906 | S | | 3/1961 | Best et al. |
| 3,145,050 | A | | 8/1964 | Edwards |
| D209,040 | S | | 10/1967 | Aleks et al. |
| 3,414,909 | A | | 12/1968 | Provi et al. |
| 3,414,910 | A | | 12/1968 | Provi et al. |
| 3,448,468 | A | | 6/1969 | Murcott |
| 3,968,524 | A | | 7/1976 | Zentman |
| 4,185,811 | A | | 1/1980 | Long |
| 4,220,322 | A | * | 9/1980 | Hobday ..... 269/6 |
| 4,417,361 | A | | 11/1983 | Smith |
| 4,436,294 | A | | 3/1984 | Irelan |
| 4,512,042 | A | | 4/1985 | Striegel et al. |
| D286,068 | S | | 10/1986 | Landsberger |
| 4,887,323 | A | | 12/1989 | Divito et al. |
| 4,893,801 | A | * | 1/1990 | Flinn ..... 269/6 |
| D316,139 | S | | 4/1991 | Divito et al. |
| 5,161,787 | A | | 11/1992 | Hobday |
| 5,249,315 | A | | 10/1993 | Moylan |
| D373,624 | S | | 9/1996 | Obitts |

(Continued)

*Primary Examiner*—Huyen Le
(74) *Attorney, Agent, or Firm*—Calfee, Halter & Griswold LLP

(57) ABSTRACT

The invention is for a tub grip for a bathtub that assists bathers in entering and exiting a bathtub. The tub grip is sturdy and easy to attach and remove for those that may suffer from loss of strength and dexterity due to advanced age, injury, illness, or other medical condition. In addition, the tub grip is constructed to resist wear and tear and provide its users with a substantial service life. One embodiment of the invention comprises a locking member, a first arm assembly, a clamp assembly, a second arm assembly, and, at least one locking plate. The first and the second arm assemblies and the locking plate are mounted on the locking member, whereas the clamp assembly is attached to the locking member. The locking member comprises a plurality of teeth, to which the locking plate is selectively engageable.

19 Claims, 9 Drawing Sheets

U.S. PATENT DOCUMENTS

| | | | |
|---|---|---|---|
| D377,827 | S | 2/1997 | Dhanapal et al. |
| D380,530 | S | 7/1997 | Stanton |
| 5,659,904 | A | 8/1997 | Doczy et al. |
| D396,793 | S | 8/1998 | Magnusson |
| 6,332,230 | B1 | 12/2001 | Chang |
| D466,787 | S | 12/2002 | Clancy |
| D487,587 | S | 3/2004 | Gilbert et al. |
| D489,799 | S | 5/2004 | Gilbert et al. |
| D490,507 | S | 5/2004 | Gilbert et al. |
| 7,203,978 | B1 | 4/2007 | Chang |
| 2005/0217017 | A1 | 10/2005 | Moser |

* cited by examiner

REMOVABLE TUB GRIP

FIELD OF INVENTION

This invention generally relates to bathtub safety devices. More specifically, the invention relates to removable tub grips that can be secured to a bathtub to assist bathers entering and exiting the bathtub.

BACKGROUND OF INVENTION

It is well known that entering and exiting a bathtub can be hazardous to a bather. The typical home bathroom setting often includes items made from porcelain, hard plastics, tile, and other like materials. The surfaces of such materials are known to become slippery when wet. Typically a bather has to step over a bathtub wall to enter and exit a bathtub. This causes the bather to maintain balance on one foot while the foot is located on a potentially wet and slippery surface. The challenge of entering and exiting a bathtub is exacerbated when the bather's balance is impaired due to advanced age, injury, illness or other medical condition.

One method of greatly reducing the hazards to bathers it to provide a sturdy device for the bather to manually grasp, to assist in maintaining balance and stability, while entering and exiting a bathtub. This type of device is generally referred to as a tub grip. Nearly all bathtubs have at least one portion that is unimpeded by obstacles, such as the walls of the room, by which the bather enters and exits the bathtub. One common arrangement for providing a sturdy support is to attach such a support to an unimpeded portion of the bathtub. This provides a device that supplies stability where it is most needed and can be most conveniently utilized by the bather.

In general, there are deficiencies in exiting tub grips that can be traced to the functionality and design of current devices. One such deficiency is the lack of overall strength and stability of present tub grips. The stability of current devices is undermined by the method of attachment. Attachment methods typically rely on a user's strength and dexterity to secure the tub grip to a bathtub wall. One such attachment method utilizes a threaded rod, with one end attached to a knob and the other end passing through a nut that is secured within the tub grip. The user attaches the device to the bathtub wall by manually turning or twisting the knob, which moves one or more sections of the tub grip into contact with the bathtub wall to form an attachment. This process, and others like it, provide profound challenges to users that lack the hand strength, due to advanced age, injury, illness, or other medical condition, to perform such an operation. Any requirement above using a mild manual force to attach and detach a tub grip renders the tub grip unusable for a portion of the population.

Another deficiency in current tub grips is the limited number of times that a tub grip can be attached and detached from a bathtub wall before the device is rendered ineffective due to wear and tear of components. The numerous attachments and detachments, coupled with the relatively large forces needed to secure the tub grip to a bathtub wall, cause components to deform and fail over time. These failures erode the usefulness of the device over time.

SUMMARY OF INVENTION

The invention is for a tub grip for a bathtub that is sturdy and easy to attach and remove for those that may suffer from loss of strength and dexterity due to advanced age, injury, illness or other medical condition. In addition, the tub grip is constructed to resist wear and tear and provide its users with a substantial service life. One embodiment of the invention comprises a locking member, a first arm assembly, a clamp assembly, a second arm assembly, and, at least one locking plate. The first and the second arm assemblies and the locking plate are mounted on the locking member, whereas the clamp assembly is attached to the locking member. The locking member comprises a plurality of teeth, to which the locking plate is selectively engageable.

BRIEF DESCRIPTION OF DRAWINGS

The present invention will be more fully understood by reference to the following detailed description of the invention and the accompanying drawings. The drawings represent exemplary embodiments of the present invention and are included for illustrative purposes in order to facilitate understanding of the description. Other embodiments of the present invention contemplated by the description are included within this application to the extend they fall within the scope of the claims attached hereto.

DETAILED DESCRIPTION OF ILLUSTRATED EMBODIMENTS

Figure 1:
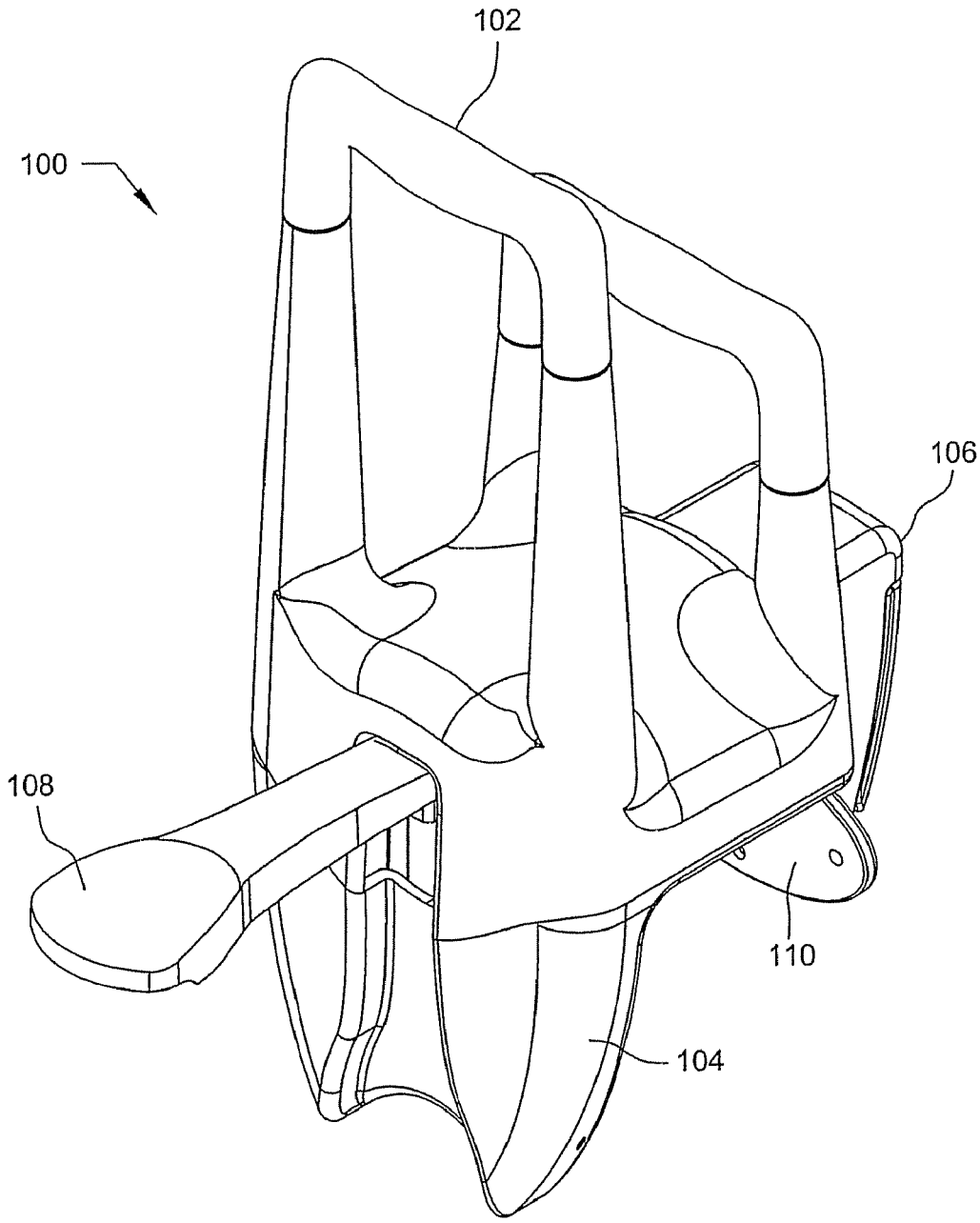
FIG. 1 is an exemplary perspective view of a tub grip.
Figure 2:
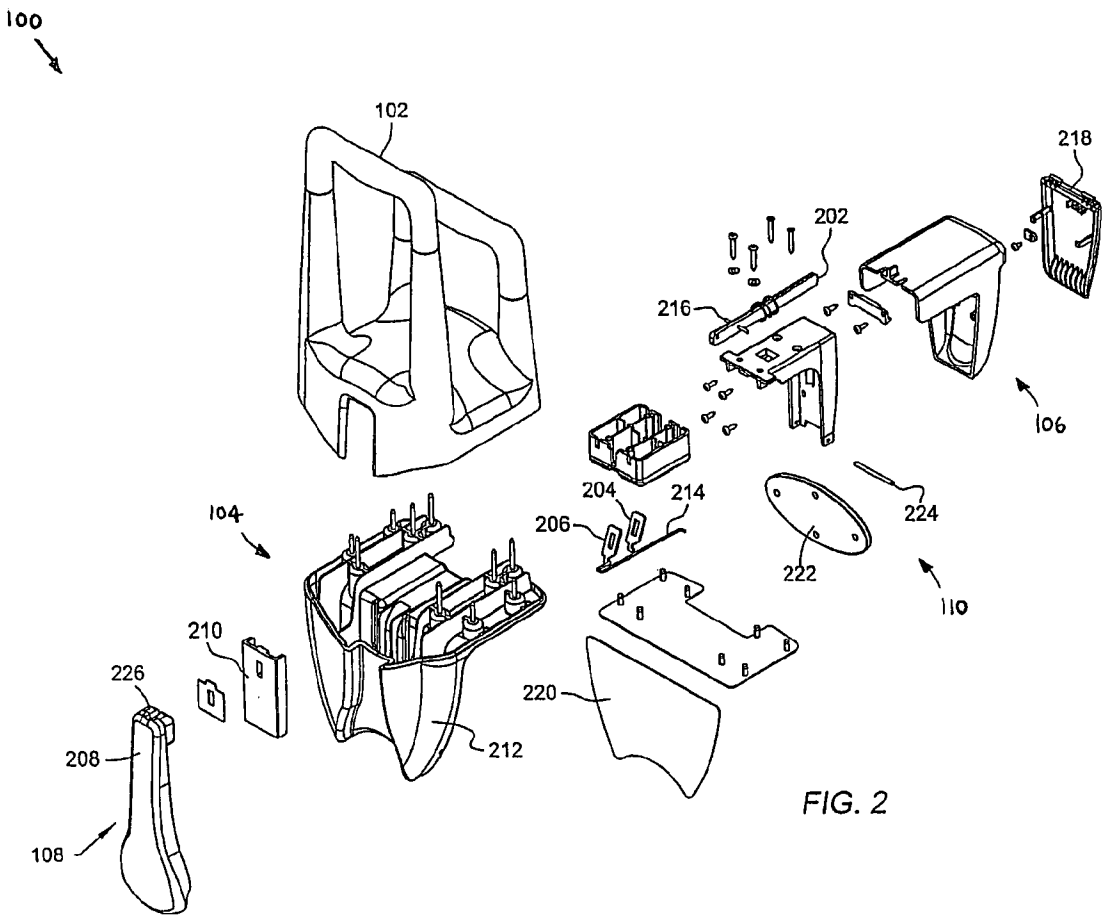
FIG. 2 is an exploded view of the tub grip in FIG. 1.
Figure 6:
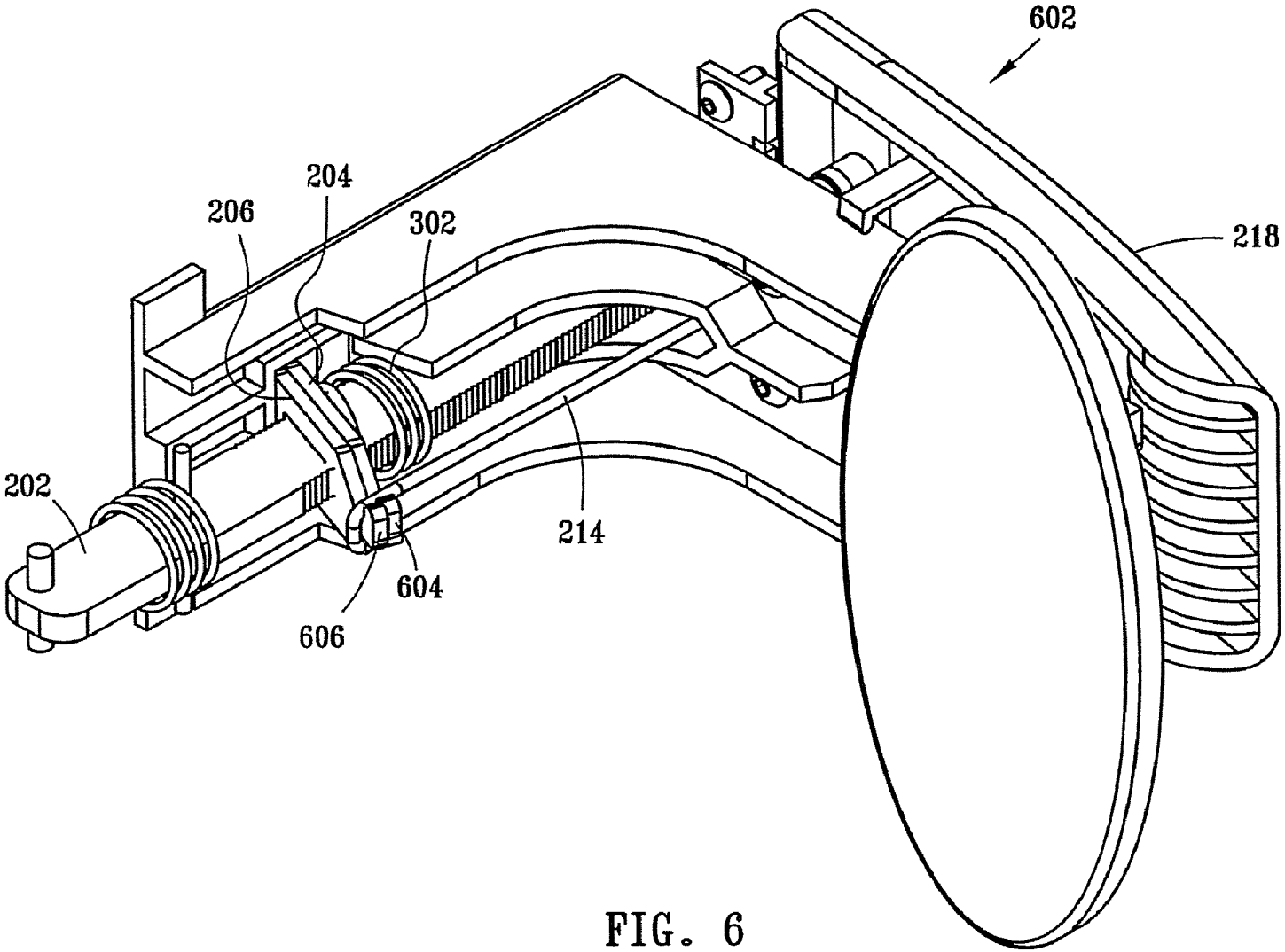
FIG. 6 is an exemplary perspective view of a locking plate release mechanism.

One preferred embodiment of a tub grip 100, as shown in FIGS. 1, 2 and 6, includes a handle assembly 102, a first arm assembly 104, a second arm assembly 106, a clamp assembly 108, a locking member 202, a pair of locking plates 204, 206, and a locking plate release mechanism 602. So configured, the tub grip 100 can be removably secured to a bathtub to assist bathers in entering and exiting the bathtub. FIG. 2 shows an exploded view of the tub grip 100.

The clamp assembly 108 is pivotally attached to an end portion of the locking member 202. The clamp assembly 108 is comprised of a clamp lever 208 and a cam 226. The first arm assembly 104 is mounted on the locking member 202, proximate to the clamp assembly 108. The first arm assembly 104 comprises a first arm assembly housing 212, removably coupled to a pressure plate 210, and a first arm assembly pad 220 attached to the first arm assembly housing 212. The mounting of the first arm assembly 104 is achieved by passing the locking member 202 through an aperture in the pressure plate 210.

The locking member 202 can be any structural component that has a large ratio of length of the component as compared to its height or diameter. In the preferred embodiment, the locking member 202 has an approximately rectangular cross-section, where the cross-sectional height is substantially larger than the width. Views of the locking member 202 of the tub grip 100 can be seen in FIGS. 2 through 6.

The second arm assembly 106 is slidably mounted on the locking member 202. Slidably mounted refers to the locking member 202 constraining the arm 106 in two directions of movement while allowing freedom of movement in a third direction, where the third direction is along the length of the locking member 202. This configuration allows for the position of the second arm assembly 106 to be adjusted with respect to the first arm assembly 104.

The pair of locking plates 204, 206 are slidably and tiltably mounted on the locking member 202. The plates 204, 206 are placed in contact with one another and located within the length of the locking member 202 that is occupied by the second arm assembly 106. Tiltably mounted refers to the ability of the locking plates 204, 206 to rotate a given amount, with respect to the length of the locking member 202. The locking plates 204, 206 are mounted by passing the locking member 202 through apertures in the locking plates 204, 206. The ability to tilt or rotate is achieved by the aperture in the locking plates 204, 206 having a height that is greater than the height of the locking member 202. Although the preferred embodiment employs two locking plates 204, 206, the invention is not limited to two. The invention can utilize one locking plate or numerous locking plates.

In general, the method of securely attaching the tub grip 100 to a bathtub, in the preferred embodiment, relies on positioning the first arm assembly 104 in contact with one side of a bathtub wall and adjusting the position of the second arm assembly 106, by sliding the second arm assembly 106 along the locking member 202 and towards the stationary first arm assembly 104, until the second arm assembly 106 is in contact with an opposing side of the bathtub wall. Once the first and second arm assemblies 104, 106 are in position, the tub grip 100 applies an adequate clamping force to the bathtub wall to form a secure attachment and bear the weight of a bather entering and exiting the bathtub.

The positioning of the second arm assembly 106 can be enabled by a ratcheting mechanism. A ratcheting mechanism generally allows a component to have relative motion in only one direction, with respect to a second component. In the preferred embodiment of this invention, the ratcheting mechanism allows the second arm assembly 106 to move towards the first arm assembly 104 and resists movement away from the first arm assembly 104. In positioning the second arm assembly 106 a bather can use manual force to move the second arm assembly 106 towards the wall of the bathtub until the there is sufficient clamping force to secure the tub grip 100 to the bathtub wall. In some cases, this process may generate an attachment sufficient to support the weight of a bather entering and exiting a bathtub.

In cases where the attachment is not sufficient to support the weight of the bather the clamping force can be enhanced by the clamp assembly 108. The clamping force is enhanced when the clamp assembly 108 draws the second arm assembly 106 towards the first arm assembly 104. This is achieved when the clamp lever 208 is moved from a horizontal position to a vertical position. The clamp assembly 108 transfers rotational motion and force into linear motion and force. In addition, the lever provides a mechanical advantage to the user. A downward force placed on the clamp lever 208 is multiplied as it is converted to a linear force. This resultant linear force is normally greater than a force the user could manually apply directly to the second arm assembly 106.

Figure 3:
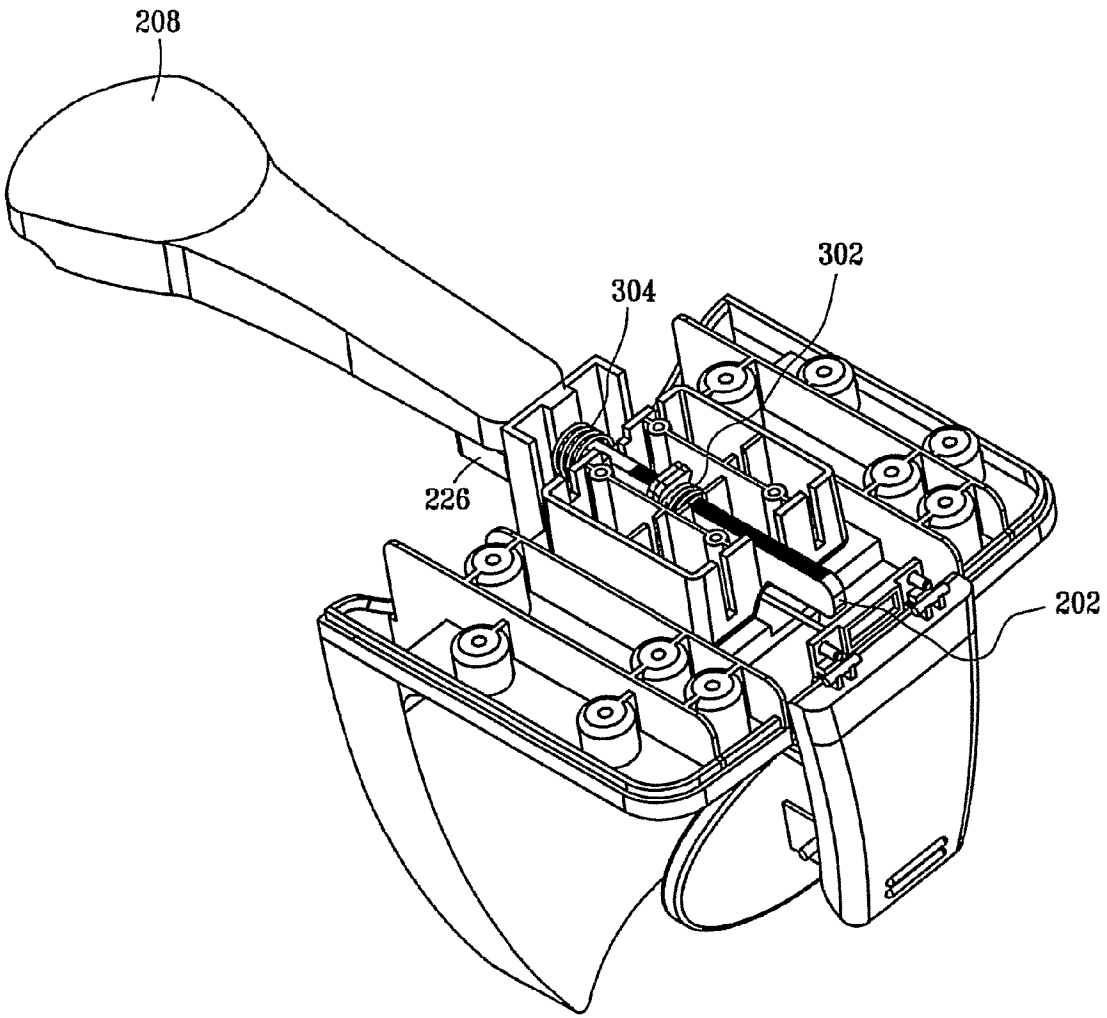
FIG. 3 is an exemplary perspective view of the internal configuration of the tub grip.
Figure 4:
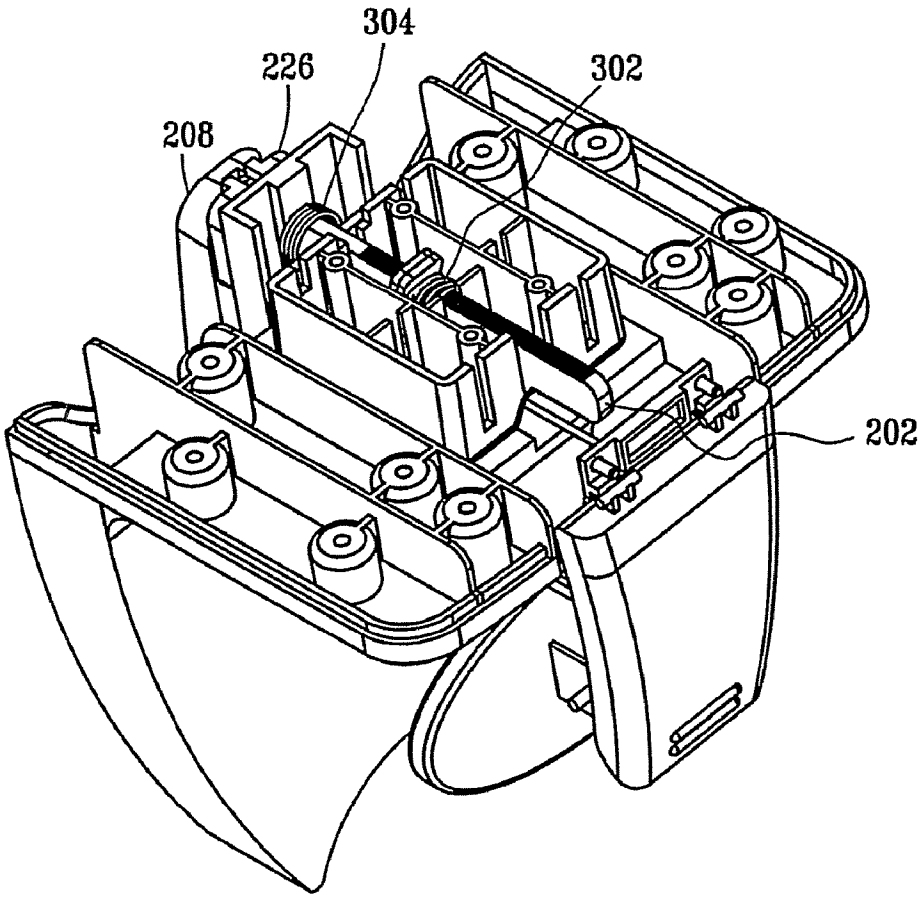
FIG. 4 is a view similar to FIG. 3 with a clamp lever actuated.
Figure 5:
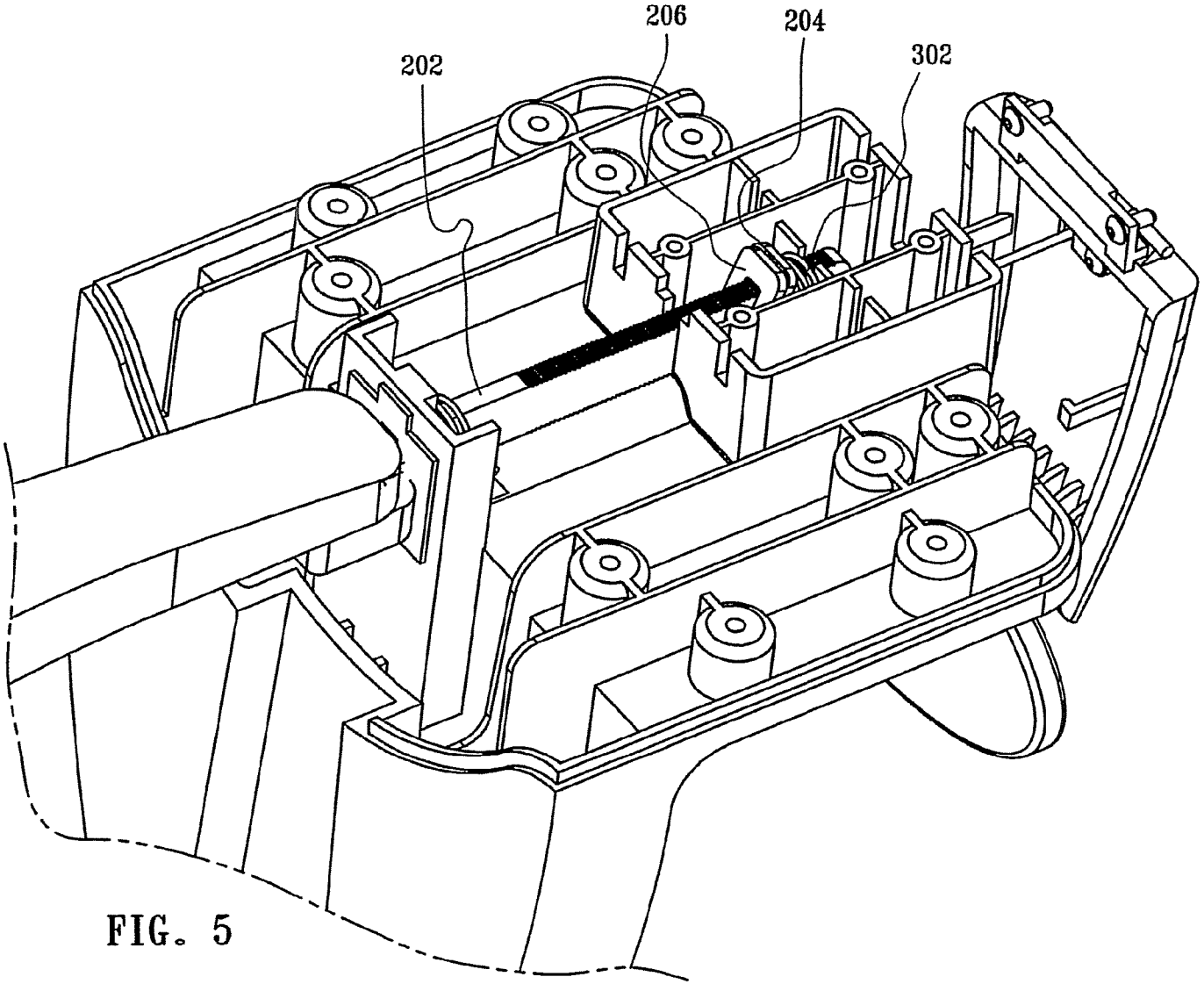
FIG. 5 is an exemplary perspective view of relationship between the locking member, the locking plate, and a locking plate spring.

While the user positions the second arm assembly 106, the clamp lever 208 is normally in a horizontal position, as shown in FIG. 3. The clamp assembly 108 is actuated by applying a downward force on the clamp lever 208, which pivots with respect to the locking member 202, and moves the clamp lever 208 to a vertical position, as is shown in FIG. 4. The clamp lever 208 is coupled to the cam 226, which is in contact with the first arm assembly 104, via the pressure plate 210. As the clamp lever 208 is moved downward, the interaction of the cam 226 on the stationary pressure plate 210 causes the locking member 202 to move towards the clamp assembly 108. This causes the second arm assembly 106 to move towards the first arm assembly 104, which increases the clamping force and creates a more secure attachment of the tub grip 100 to the bathtub wall.

During the attachment process the clamp lever 208 is normally held in the horizontal position by a clamp spring 304. The clamp spring 304 is positioned between the pressure plate 210 and a pin stop 216 and in a state of compression. This compression applies a force on the pressure plate 210, which transfers that force to the cam 226 and urges the clamp lever 208 to remain in a horizontal position. The spring force is relatively mild and is easily overcome by the downward force applied to the end of the clamp lever 208. The configuration of the clamp spring 304, the pin stop 216, the pressure plate 210, the cam 226, and the clamp lever 208 can be seen in FIG. 7.

The first arm assembly pad 220 and a pivot pad assembly 110, which is coupled to the second arm assembly 106, can play a role in creating a secure attachment in the preferred embodiment. The first arm assembly pad 220 and the pivot pad assembly 110 are positioned to be in contact with opposite sides of the bathtub wall when the tub grip 100 is attached. Both have a friction pad that resists slippage when in contact with the tub wall. In addition, the pivot pad assembly 110, which is comprised of a pivot pad 222 and a pivot pad pin 224, is pivotally coupled to the second arm assembly 106. This allows the second arm assembly 106 to maintain full contact with the tub wall, via the pivot pad 222, while the clamp assembly 108 draws the second arm assembly 106 towards the first arm assembly 104 during the attachment process.

In the preferred embodiment of the invention, the ratchet mechanism is comprised of the locking member 202, the locking plates 204, 206, a locking plate spring 302 in contact with the first locking plate 204, and a locking surface 702 in contact with the second locking plate 206. The locking member 202 has a plurality of teeth configured as two series 802, 804 and located along the length of the upper and lower surfaces of the locking member 202, respectively. The ratcheting behavior is enabled by the locking plates 204, 206, which serve as pawls, engaging the two series of teeth 802, 804. The apertures of the locking plates 204, 206 have flat upper and lower edge portions which can engage the upper and lower series of teeth 802, 804. This engagement occurs when the locking plates 204, 206 are tilted until the upper and lower edge portions come into substantial contact with the upper and lower series of teeth 802, 804. This configuration will restrict the movement of the locking plates 204, 206 along the length of the locking member 202 in one direction. When the locking plates 204, 206 are returned to an upright position, perpendicular to the length of the locking member 202, the upper and lower edge portions will disengage the teeth 802, 804 and allow the locking plates 204, 206 movement along the length of the locking member 202 in both directions.

Figure 7:
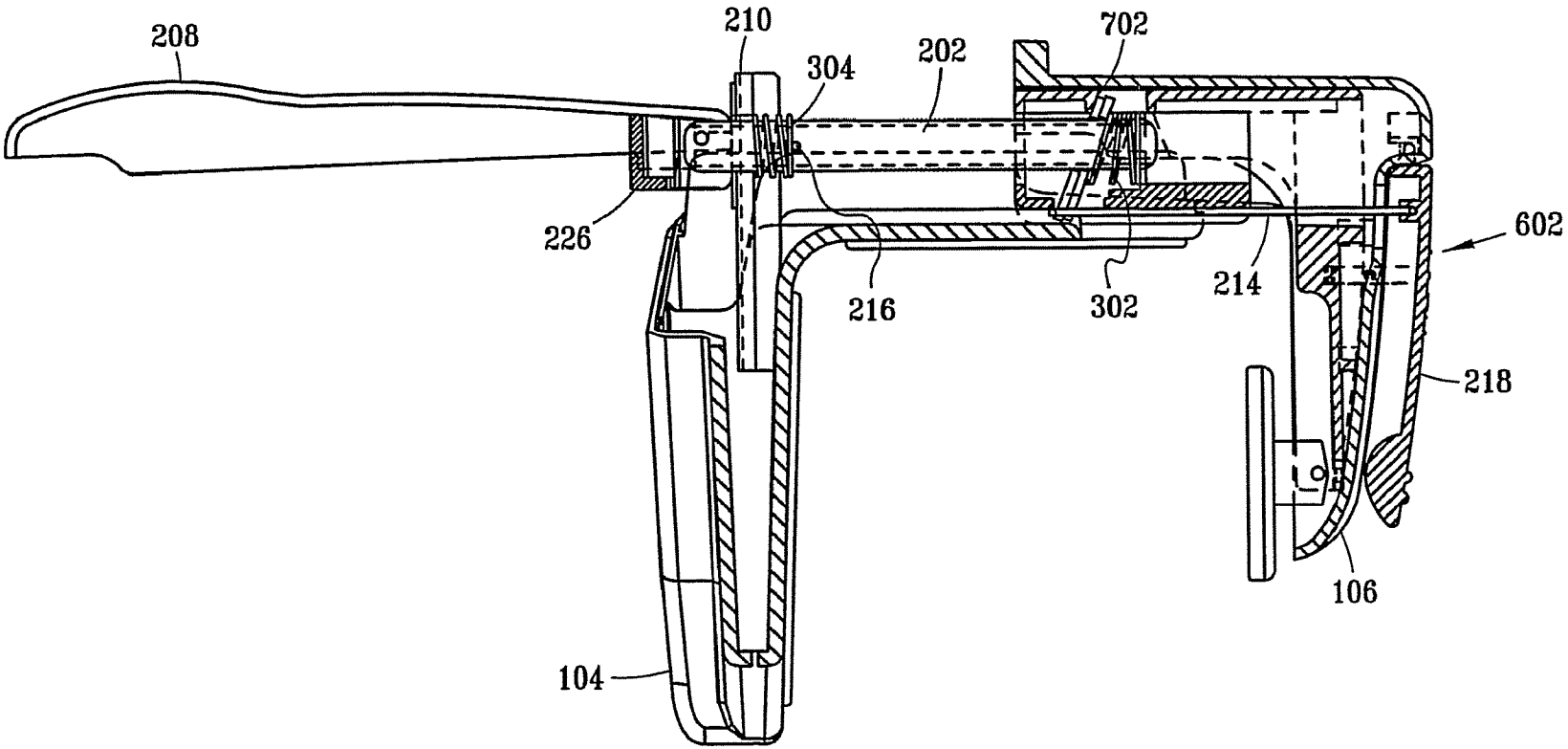
FIG. 7 is a cross-sectional side view of the tub grip.
Figure 8:
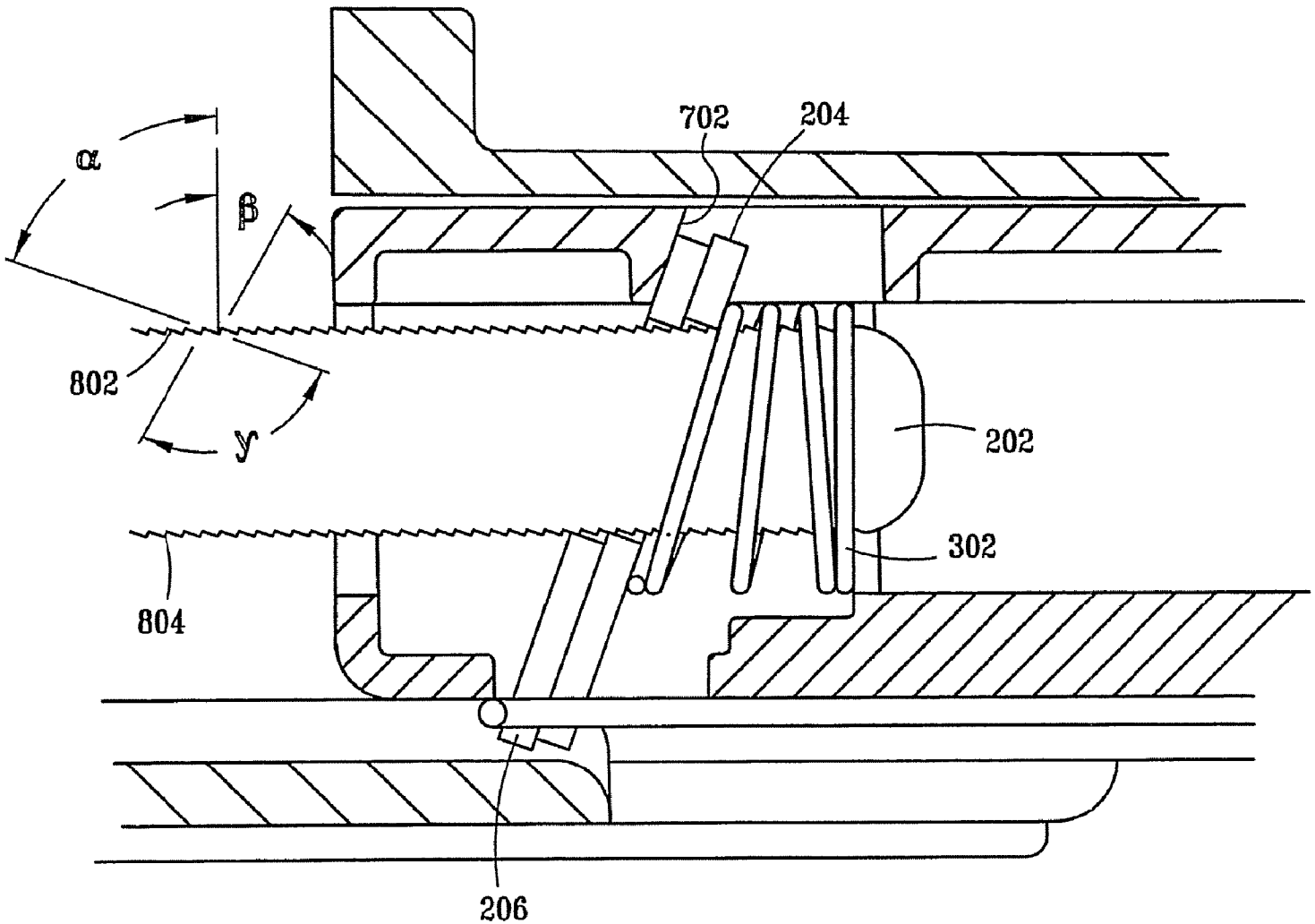
FIG. 8 is a cross-sectional side view detailing the locking plates, the locking member, a locking surface, and the locking plate spring.

The preferred method for tilting the locking plates 204, 206 is enabled by the locking plate spring 302 and the locking surface 702, as shown in detail in FIGS. 7 and 8. The locking plate spring 302 is mounted on the locking member 202 and placed in contact with the first locking plate 204. The locking plate spring 302 is configured so that it is also in contact with a portion of the second arm assembly 106 and is maintained in a state of compression. The locking plate spring's 302 compression state urges the locking plates 204, 206 away from the locking plate spring 302. The locking surface 702, which serves as a mechanical stop, is positioned to be in contact with an upper portion of the second locking plate 206. The locking surface 702 is a portion of the second arm assembly 106. The combination of the spring force, applied at roughly the center of the first locking plate 204, and an opposing force supplied by the locking surface 702 and applied near the upper extreme of the second locking plate 206, causes the locking plates 204, 206 to tilt. The tilting, or rotation, will be about the line of contact between the locking surface 702 and the second locking plate 206. This tilting behavior will result in the lower portions of the locking plates 204, 206 moving further away from the locking plate spring 302 than the upper portions of the locking plates 204, 206 and in the lower portions of the locking plates 204, 206 being located closer to the first arm assembly 104 than are the upper portions of the locking plates 204, 206. The relationship of the locking plates 204, 206, the locking plate spring 302, the locking member 202, and the locking surface 702 results in a ratcheting behavior that allows the second arm assembly 106 to move towards the first arm assembly 104 and resist movement away from the first arm assembly 104.

Figure 9:
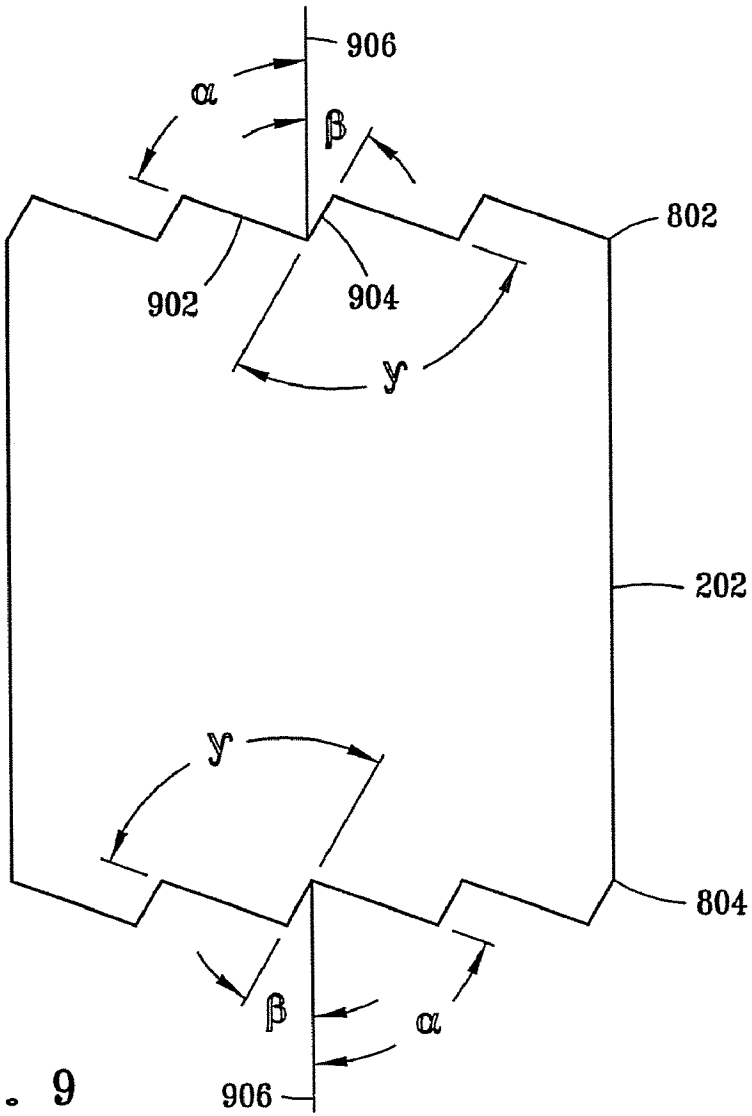
FIG. 9 is an illustrative view detailing a geometric relationship of teeth of the locking member.

The ratcheting behavior is further influenced by the geometry of the teeth 802, 804. A tooth generally has two edge portions, a first edge portion 902 and a second edge portion 904 (see FIG. 9). The tooth and the edge portions can be distinguished by characteristic angles alpha ($\alpha$), beta ($\beta$), and gamma ($\gamma$) as shown in FIGS. 8 and 9. A characteristic angle for the tooth is the angle defined by the intersection of the first edge portion 902 and the second edge portion 904 at the peak of the tooth, labeled gamma in FIGS. 8 and 9. Characteristic angles for the first and second edge portions 902, 904 are the angles between a line defined by the first and second edge portions 902, 904 and a center line 906 passing through the trough or valley between two adjacent teeth. FIGS. 8 and 9 show the characteristic angle for the first edge portion 902 as alpha and the characteristic angle for the second edge portion 904 as beta. The characteristic angles will determine how much resistance the locking plates 204, 206 provide as the ratchet is urged in the direction of allowable motion and how rigid the ratcheting mechanism is when urged in the direction that motion is restricted. In the preferred embodiment the teeth 802, 804 have characteristic angles of 100° (gamma), the first edge portions 902 have characteristic angles of 70° (alpha) and the second edge portions 904 have characteristic angles of 30° (beta).

The invention is not limited to the use of locking plates with apertures mounted on a toothed locking member. There are a number of methods by which ratcheting behavior can be achieved, included, but not limited to, the use of one way gears or a spring loaded pin to engage a toothed locking member. In addition, ratcheting behavior can be achieved without the toothed locking member. One skilled in the art would immediately recognized that a variety of material properties and geometries are capable of producing ratcheting behavior.

In general, the process for removing the tub grip 100 from the wall of a bathtub relies on disengaging the locking plates 204, 206 from the locking member 202. This action is provided for by the locking plate release mechanisms 602, which is shown in FIG. 6. The locking plate release mechanism 602 includes a locking plate release lever 218 and a locking plate release wire 214. The locking plate release wire 214 is attached, on one end, to the locking plate release lever 218 and coupled, on the other end, to a pair of hooks 604, 606 extending from the bottom of the locking plates 204, 206. When the locking plate release lever 218 is actuated, by pulling it away from the locking plates 204, 206, the locking plate release wire 214 exerts a force on the locking plates 204, 206 and moves the locking plates 204, 206 towards a vertical position. The locking plates 204, 206 pivot about a line of contact between the second locking plate 206 and the locking surface 702. This results in the upper and lower edge portions of the aperture disengaging from the teeth 802, 804 of the locking member 202. The force exerted on the locking plates 204, 206 by the locking plate release mechanism 602 must be large enough to overcome the force that the locking plate spring 302 exerts on the first locking plate 204, which is urging the locking plates 204, 206 to remain in a tilted position. Once the upper and lower edge portions of the locking plate apertures are no longer in substantial contact with the teeth of the locking member 202, the second arm assembly 106 can be manually moved away from the first arm assembly 104. This releases the clamping force on the bathtub wall and allows the tub grip 100 to be removed.

In the preferred embodiment, the locking plate release lever 218 is attached to the second arm assembly 106. The locking plate release wire 214 passes through the second arm assembly 106 to couple to the locking plates 204, 206. This configuration serves to apply a force that urges the second arm assembly 106 away from the first arm assembly 104 as the user pulls on the clamp lever 208 to disengage the locking plates 204, 206. Once the second arm assembly 106 is moved away from the bathtub wall, the locking plate release lever 218 can be returned to its original position. This will cause the spring force from the locking plate spring 302 to return the locking plates 204, 206 to a tilted position, which reinstates the ratcheting behavior. Although the preferred embodiment references a locking plate release wire 204, this component can be any connector that is capable of relaying force from one component to another while in a state of tension. The preferred embodiment also utilized hooks 604, 606 on the locking plates 204, 206 to which the locking plate release wire 214 can couple. The invention is not limited to such coupling. One knowledgeable in the art would immediately see numerous methods of coupling, such as, but not limited to, coupling through a pin hole or other aperture or coupling through adhesives.

The repeated attaching and detaching of the tub grip 100 can cause wear and tear on some of the components, namely the locking member 202 and the locking plates 204, 206. Both the teeth 802, 804 on the locking member 202 and the upper and lower portions of the apertures in the locking plates 204, 260 could lose effectiveness if too much wear accumulates. This potential issue can be addressed by constructing these components out of hardened materials, such as metals or very durable plastics. In the preferred embodiments of this invention, the material used for the locking plates 204, 206 and the locking member 202 is stainless steel.

While the present invention has been illustrated by the description of embodiments thereof, and while the embodiments have been described in considerable detail, the described embodiments are not intended to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the general inventive concept.

The invention claimed is:

1. A removable tub grip for mounting on an exposed wall of a bathtub, said tub grip comprising:

a first arm assembly for contacting a first side of said exposed tub wall, a second arm assembly for contacting a second side of said exposed tub wall;

a ratcheting mechanism; and a handle assembly, wherein at least a portion of said handle assembly is operable to be positioned above and between said first side and said second side of said exposed tub wall when said first arm assembly contacts said first side and said second arm assembly contacts said second side;

wherein said first arm assembly is fixed relative to said ratcheting mechanism;

wherein said second arm assembly is operable to move toward said first arm assembly via said ratcheting mechanism;

wherein said ratcheting mechanism restricts movement of said second arm assembly away from said first arm assembly and allows movement of said second arm assembly toward said first arm assembly;

wherein said handle assembly is discrete and fixed relative to said ratcheting mechanism wherein said ratcheting mechanism includes a locking member and a locking plate;

wherein said locking member includes a plurality of teeth;

wherein said locking member includes a spring mounted on said locking member and in communication with said locking plate;

wherein said locking plate selectively engages said teeth to restrict movement of said second arm assembly away from said first arm assembly and allow movement of said second arm assembly toward said first arm assembly; and wherein said spring urges said locking plate toward said first arm assembly.

2. The removable tub grip of claim 1 further comprising a clamp assembly, wherein said clamp assembly is connected to said ratcheting mechanism, and wherein actuating said clamp assembly causes said second arm assembly to move toward said first arm assembly.

3. The removable tub grip of claim 2 wherein said clamp assembly is operable to convert a rotational force into an increased linear force for moving said second arm assembly toward said first arm assembly.

4. The removable tub grip of claim 2, wherein said clamp assembly includes a lever coupled to a cam in contact with said first arm assembly, wherein said cam is configured to redirect and multiply a force placed on a portion of said lever distal to said cam to route said lever, and wherein said force used to actuate said lever is redirected to displace said second arm assembly in a linear manner toward said first arm assembly.

5. The removable tub grip of claim 1, wherein said handle assembly includes a first handle and a second handle, wherein said first handle is located above and connects a first pair of vertical posts, and wherein said second handle is located above and connects a second pair of vertical posts.

6. The removable tub grip of claim 1, wherein a length of said locking member is substantially greater than a height of said locking member.

7. The removable tub grip of claim 1, wherein a length of said locking member is substantially greater than a width of said locking member.

8. The removable tub grip of claim 1, wherein a height of said locking member is greater than a width of said locking member.

9. The removable tub grip of claim 1, further comprising a locking plate release mechanism, wherein said locking plate release mechanism is operable to disengage said locking plate from said teeth to allow movement of said second arm assembly away from said first arm assembly.

10. The removable tub grip of claim 1, wherein each of said plurality of teeth is a tooth having a first edge portion and a second edge portion.

11. The removable tub grip of claim 10, wherein said tooth has a characteristic angle defined by an intersection of said first edge portion and said second edge portion at a peak of said tooth.

12. The removable tub grip of claim 10, wherein said tooth has a characteristic angle defined as an angle between said first edge portion and a line passing through a valley where two adjacent teeth meet.

13. The removable tub grip of claim 12, wherein said characteristic angle is 70 degrees.

14. The removable tub grip of claim 10, wherein said tooth has a characteristic angle defined as an angle between said second edge portion and a line passing through a valley where two adjacent teeth meet.

15. The removable tub grip of claim 14, wherein said characteristic angle is 30 degrees.

16. A removable tub grip for mounting on an exposed wall of a bathtub, said tub grip comprising:

a first arm assembly for contacting a first side of said exposed tub wall, a second arm assembly for contacting a second side of said exposed tub wall;

a ratcheting mechanism:

a locking plate release mechanism; and a handle assembly, wherein at least a portion of said handle assembly is operable to be positioned above and between said first side and said second side of said exposed tub wall when said first arm assembly contacts said first side and said second arm assembly contacts said second side;

wherein said first arm assembly is coupled to said second arm assembly by said ratcheting mechanism;

wherein said first arm assembly is fixed relative to said ratcheting mechanism:

wherein said second arm assembly is operable to move toward said first arm assembly via said ratcheting mechanism;

wherein said ratcheting mechanism restricts movement of said second arm assembly away from said first arm assembly and allows movement of said second arm assembly toward said first arm assembly;

wherein said handle assembly is discrete and fixed relative to said ratcheting mechanism;

wherein said ratcheting mechanism includes a locking member and a locking plate:

wherein said locking member includes a plurality of teeth;

wherein said locking plate selectively engages said teeth to restrict movement of said second arm assembly away from said first arm assembly and allow movement of said second arm assembly toward said first arm assembly;

wherein said locking plate release mmmechanism is operable to disengage said locking plate from said teeth to allow movement of said second arm assembly away from said first arm assembly;

wherein said locking plate release mechanism includes a release lever and a guide wire having a first end portion and a second end portion; and wherein said first end portion is coupled to said release lever and said second end portion is coupled to a hook extending from said locking plate.

17. A removable tub grip for mounting on an exposed wall of a bathtub, said tub grip comprising:

a first arm assembly for contacting a first side of said exposed tub wall, a second arm assembly for contacting a second side of said exposed tub wall;

a ratcheting mechanism; and a handle assembly, wherein at least a portion of said handle assembly is operable to be positioned above and between said first side and said second side of said exposed tub wall when said first arm assembly contacts said first side and said second arm assembly contacts said second side;

wherein said first arm assembly is coupled to said second arm assembly by said ratcheting mechanism;

wherein said first arm assembly is fixed relative to said ratcheting mechanism;

wherein said second arm assembly is operable to move toward said first arm assembly via said ratcheting mechanism; and wherein said ratcheting mechanism restricts movement of said second arm assembly away from said first arm assembly and allows movement of said second arm assembly toward said first arm assembly,;

wherein said handle assembly is discrete and fixed relative to said ratcheting mechanism wherein said ratcheting mechanism includes a locking member and a locking plate;

wherein said locking member includes a plurality of teeth;

wherein said locking plate selectively engages said teeth to restrict movement of said second arm assembly away from said first arm assembly and allow movement of said second arm assembly toward said first arm assembly; and wherein said plurality of teeth form a first row of teeth on a top surface of said locking member and a second row of teeth on a bottom surface of said locking member.

18. The removable tub grip of claim 17, wherein said locking plate has an aperture through which said locking member extends, wherein an upper flat portion of said aperture is operable to engage said first row of teeth, and wherein a lower flat portion of said aperture is operable to engage said second row of teeth.

19. A removable tub grip for mounting on an exposed wall of a bathtub, said tub grip comprising:

a first arm assembly for contacting a first side of said exposed tub wall, a second arm assembly for contacting a second side of said exposed tub wall;

a ratcheting mechanism; and a handle assembly, wherein at least a portion of said handle assembly is operable to be positioned above and between said first side and said second side of said exposed tub wall when said first arm assembly contacts said first side and said second arm assembly contacts said second side;

wherein said first arm assembly is fixed relative to said ratcheting mechanism;

wherein said second arm assembly is operable to move toward said first arm assembly via said ratcheting mechanism;

wherein said ratcheting mechanism restricts movement of said second arm assembly away from said first arm assembly and allows movement of said second arm assembly toward said first arm assembly;

wherein said handle assembly is discrete and fixed relative to said ratcheting mechanism wherein said ratcheting mechanism includes a locking member and a locking plate;

wherein said locking member includes a plurality of teeth;

wherein said locking plate selectively engages said teeth to restrict movement of said second arm assembly away from said first arm assembly and allow movement of said second arm assembly toward said first arm assembly;

wherein each of said plurality of teeth is a tooth having a first edge portion and a second edge portion;

wherein said tooth has a characteristic angle defined by an intersection of said first edge portion and said second edge portion at a peak of said tooth; and wherein said characteristic angle is 100 degrees.

* * * * *

UNITED STATES PATENT AND TRADEMARK OFFICE

CERTIFICATE OF CORRECTION

PATENT NO. : 7,441,285 B2
APPLICATION NO. : 10/710456
DATED : October 28, 2008
INVENTOR(S) : Douglas A. Kemp et al.

It is certified that error appears in the above-identified patent and that said Letters Patent is hereby corrected as shown below:

In Claim 16, column 9, line 4, “mmmechanism” should read “mechanism”

Signed and Sealed this

Sixteenth Day of December, 2008

JON W. DUDAS
*Director of the United States Patent and Trademark Office*